US010612303B2

(12) United States Patent
Parker et al.

(10) Patent No.: US 10,612,303 B2
(45) Date of Patent: Apr. 7, 2020

(54) LADDER LEVELER AND METHOD

(71) Applicants: Thomas W. Parker, Jamestown, PA (US); Daniel C. Mora, Transfer, PA (US); Robert D. Beggs, Stoneboro, PA (US)

(72) Inventors: Thomas W. Parker, Jamestown, PA (US); Daniel C. Mora, Transfer, PA (US); Robert D. Beggs, Stoneboro, PA (US)

(73) Assignee: Werner Co., Greenville, PA (US)

( * ) Notice: Subject to any disclaimer, the term of this patent is extended or adjusted under 35 U.S.C. 154(b) by 97 days.

(21) Appl. No.: 15/591,765

(22) Filed: May 10, 2017

(65) Prior Publication Data

US 2017/0335627 A1 Nov. 23, 2017

Related U.S. Application Data

(60) Provisional application No. 62/337,676, filed on May 17, 2016.

(51) Int. Cl.
*E06C 7/44* (2006.01)
*E06C 7/42* (2006.01)

(52) U.S. Cl.
CPC ..... *E06C 7/44* (2013.01); *E06C 7/42* (2013.01); *E06C 7/423* (2013.01); *E06C 7/426* (2013.01)

(58) Field of Classification Search
CPC ... E06C 7/42; E06C 7/44; E06C 7/426; E06C 7/423
See application file for complete search history.

(56) References Cited

U.S. PATENT DOCUMENTS 1,733,338 A * 10/1929 Enke ..... E06C 7/44 182/204
3,406,785 A * 10/1968 Pilcher ..... E06C 7/44 182/205

(Continued)

FOREIGN PATENT DOCUMENTS

DE 202013009466 U1 * 1/2014 ..... E06C 7/44
FR 2616468 A1 * 12/1988 ..... E04G 1/14

(Continued)

*Primary Examiner* — Marcus Menezes
(74) *Attorney, Agent, or Firm* — Ansel M. Schwartz

(57) ABSTRACT

A ladder upon which a user climbs having a first rail. The ladder having a second rail. The ladder having rungs attached to the first and second rails upon which the user steps. The ladder having a first leveler attached to the first rail. The first leveler having a foot peg and a latch. When the user presses on the foot peg and the latch with the user's foot when the leveler is in an extended state, the first leveler moves into a retracted state. The ladder having a second leveler attached to the second rail. A method for a user to use a ladder. The method has the step of the user pushing with the user's foot against a foot peg and latch of a first leveler to cause the first leveler to move to a retracted state relative to a first rail of the ladder in which the first leveler is. There is the step of the user pushing only against the foot peg but not the latch with the user's foot when the leveler is in the retracted state causing the first leveler to move to an extended state relative to the first rail and be maintained in the extended state. A leveler which positively prevents inadvertent retraction of the leveler from an extended state to a retracted state. A ladder having a module with a first and second ladder leveler.

6 Claims, 10 Drawing Sheets

(56) References Cited

U.S. PATENT DOCUMENTS

| | | | | | |
|---|---|---|---|---|---|
| 3,882,966 | A * | 5/1975 | Fasano | E06C 7/44 | 182/205 |
| 4,907,675 | A * | 3/1990 | Saby | E04G 1/14 | 182/104 |
| 5,678,656 | A * | 10/1997 | Lanzafame | E06C 7/44 | 182/111 |
| 6,401,866 | B1 * | 6/2002 | Roy | E06C 7/44 | 182/204 |
| 8,042,651 | B1 * | 10/2011 | Michnik | E06C 1/14 | 182/107 |
| 2010/0116592 | A1 * | 5/2010 | Clements | E06C 1/39 | 182/180.1 |

FOREIGN PATENT DOCUMENTS

| | | | | |
|---|---|---|---|---|
| FR | 2853688 | A1 * | 10/2004 | E06C 7/44 |
| WO | WO-2011055863 | A1 * | 5/2011 | E06C 7/44 |

* cited by examiner

LADDER LEVELER AND METHOD

CROSS-REFERENCE TO RELATED APPLICATIONS

This is a non-provisional of U.S. provisional application Ser. No. 62/337,676 filed May 17, 2016, incorporated by reference herein.

FIELD OF THE INVENTION

The present invention pertains to a ladder leveler which can be moved to an extended position from a retracted position by a user pushing on a foot peg of the leveler. More specifically, the present invention pertains to a ladder leveler which can be moved to an extended position from a retracted position by a user pushing on a foot peg of the leveler and maintained in the extended position by a latch of the leveler.

BACKGROUND

The use of ladder levelers allows ladders to be positioned on uneven ground in a safe and stable manner. Since ladder levelers are most commonly positioned at the bottom of the rails of a ladder, most ladder levelers require users of the ladders to have to bend over and secure the ladder levelers in an uncomfortable and possibly even and unsafe position, for instance if the ladder is located at the edge of a wall or drop off. What is needed is a simple, safe, comfortable and secure technique to allow a user to secure a ladder leveler.

SUMMARY

The present invention pertains to a ladder upon which a user climbs. The latter comprises a first rail. The ladder comprises a second rail. The ladder comprises rungs attached to the first and second rails upon which the user steps. The ladder comprises a first leveler attached to the first rail. The first leveler having a foot peg and a latch. When the user presses on the foot peg and the latch with the user's foot when the leveler is in an extended state, the first leveler moves into a retracted state. The ladder comprises a second leveler attached to the second rail.

The present invention pertains to a ladder upon which a user climbs. The ladder comprises a first rail. The ladder comprises a second rail. The ladder comprises rungs attached to the first and second rails upon which the user steps. The ladder comprises a first leveler attached to the first rail. The first leveler positively prevents inadvertent retraction of the first leveler from an extended state to a retracted state. The ladder comprises a second leveler attached to the second rail.

The first and second levelers can be part of a module that attaches to the ladder.

The present invention pertains to a method for a user to use a ladder. The method comprises the step of the user pushing with the user's foot against a foot peg and latch of a first leveler to cause the first leveler to move to a retracted state relative to a first rail of the ladder in which the first leveler is. There is the step of the user pushing only against the foot peg but not the latch with the user's foot when the leveler is in the retracted state causing the first leveler to move to an extended state relative to the first rail and be maintained in the extended state.

BRIEF DESCRIPTION OF THE DRAWINGS

In the accompanying drawings, the preferred embodiment of the invention and preferred methods of practicing the invention are illustrated in which.

DESCRIPTION OF THE INVENTION

Figure 1:
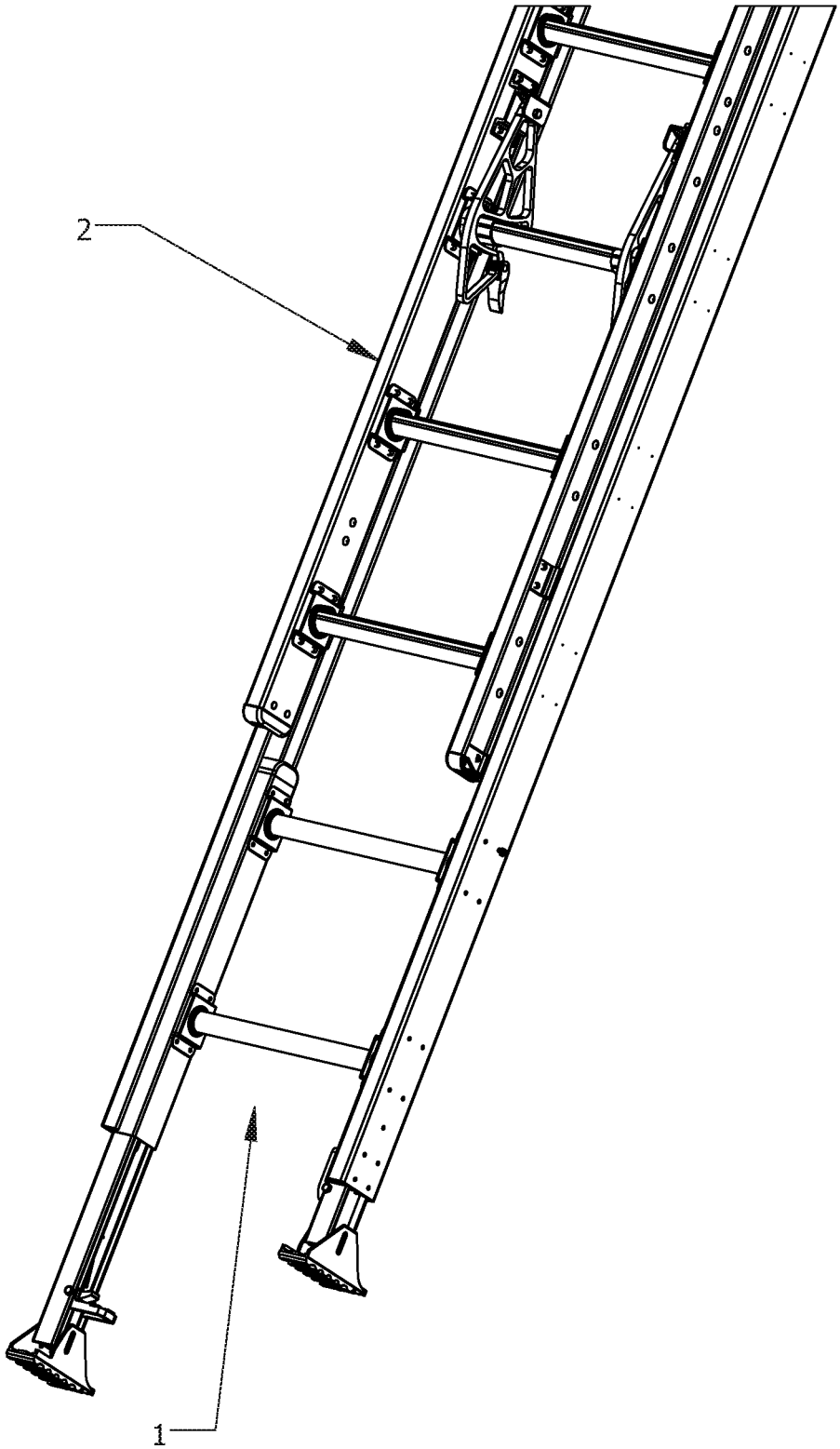
FIG. 1 shows the modular leveler installed in a typical extension ladder.

Referring now to the drawings wherein like reference numerals refer to similar or identical parts throughout the several views, and more specifically to FIGS. 1-4, thereof, there is shown a ladder 2 upon which a user climbs. The ladder comprises a first rail 55. The ladder 2 comprises a second rail 57. The ladder 2 comprises rungs 59 attached to the first and second rails upon which the user steps. The ladder 2 comprises a first leveler 61 attached to the first rail 55. The first leveler 61 having a foot peg and a latch. When the user presses on the foot peg and the latch with the user's foot when the leveler 61 is in an extended state, the first leveler 61 moves into a retracted state. The ladder 2 comprises a second leveler 63 attached to the second rail 57. The first and second levelers can be part of a module that attaches to the ladder.

The present invention pertains to a method for a user to use a ladder. The method comprises the step of the user pushing with the user's foot against a foot peg and latch of a first leveler to cause the first leveler to move to a retracted state relative to do a first rail of the ladder in which the first leveler is. There is the step of the user pushing only against the foot peg but not the latch with the user's foot when the leveler is in the retracted state causing the first leveler to move to an extended state relative to the first rail and be maintained in the extended state.

The first leveler may have a right housing 5 which contains a right leg assembly 7. The foot peg 8 and the latch 9 are foldably attached to the right leg assembly 7. The latch 9 may be encased by the foot peg 8 when the latch 9 and foot pay are folded so the latch 9 is protected by the foot peg 8 and inaccessible. The ladder 2 may include a retractor spring 13 fixed in proximity to its upper end to a bolt 14 in the right housing 5 and hooked in proximity to its lower end to a pin 15 in the right leg assembly 7. The retractor spring 13 retracts the right leg assembly 7 into the right housing 5 when the latch 9 is unmatched and the right leg assembly 7 is free to move into the retracted state. The latch 9 is unlatched when the user presses on the foot peg 8 and the latch 9.

The ladder 2 may include a latch spring 16 and a pawl assembly 17 and a rack 18 with teeth mounted rigidly to an inside of the right housing 5. The latch spring 16 attached in proximity to its upper end to the pawl assembly 17 and in proximity to its lower end to the latch 9, the latch spring 16 biases the latch 9 toward its upper position which in turn biases the pawl assembly 17 into engagement with the rack 18. The latch 9 may pivot on a bolt 21 in the right leg assembly 7, and the pawl assembly 17 has a pawl tip 19 which engages with the teeth on the rack 18.

The ladder 2 may include a pawl pin 20 mounted in proximity to an upper end of the pawl assembly 17 which slides in a diagonal slot 22 in the right leg assembly 7. When the pawl assembly 17 is assembled to the right leg assembly 7, a force applied upward on a bottom of the right leg assembly 7 is transmitted from a lower end of the diagonal slot 22 to the pawl pin 20, to the pawl tip 19 and to the rack 18. Because the diagonal slot 22 is sloped at an angle, the greater the force, the greater is the force keeping the pawl tip 19 engaged with the rack 18. When a user desires to retract the right leg assembly 7, the user may push down on a tip of the latch 9 which raises the pawl assembly 17 relative to the right leg assembly 7 which causes the pawl tip 19 to move up and away from engagement with the rack 18 as the pawl pin 20 is guided by the diagonal slot 22. Once the pawl tip 19 is disengaged from the rack 18, the leg assembly is free to rise relative to the rack 18 under the influence of the retractor spring 13.

To lower the right leg assembly 7 to level the ladder 2, the user may push down on the tip of the foot peg 8 to extend the leg, but not on the latch 9 so the pawl assembly 17 continues to push against the teeth of the rack 18. The pawl assembly 17 automatically ratchets over the teeth of the rack 18 as the pawl assembly 17 moves along the teeth of the rack 18 until the desired extension is achieved. The bias force of the retractor spring 13 causes the pin 15 to seat and be held against a tooth of the teeth at a desired extension, since the latch 9 is not pushed down while the foot peg 8 is pushed down. Putting weight on the ladder 2 causes the pawl tip 19 to be firmly and immovably engaged with the rack 18 by the increased weight creating increased force against the tooth at the desired extension. The first and second levelers may form a modular leveler 1 with rungs attached to and between them. The modular leveler attached by bolts or rivets to the first and second rails.

Figure 2:
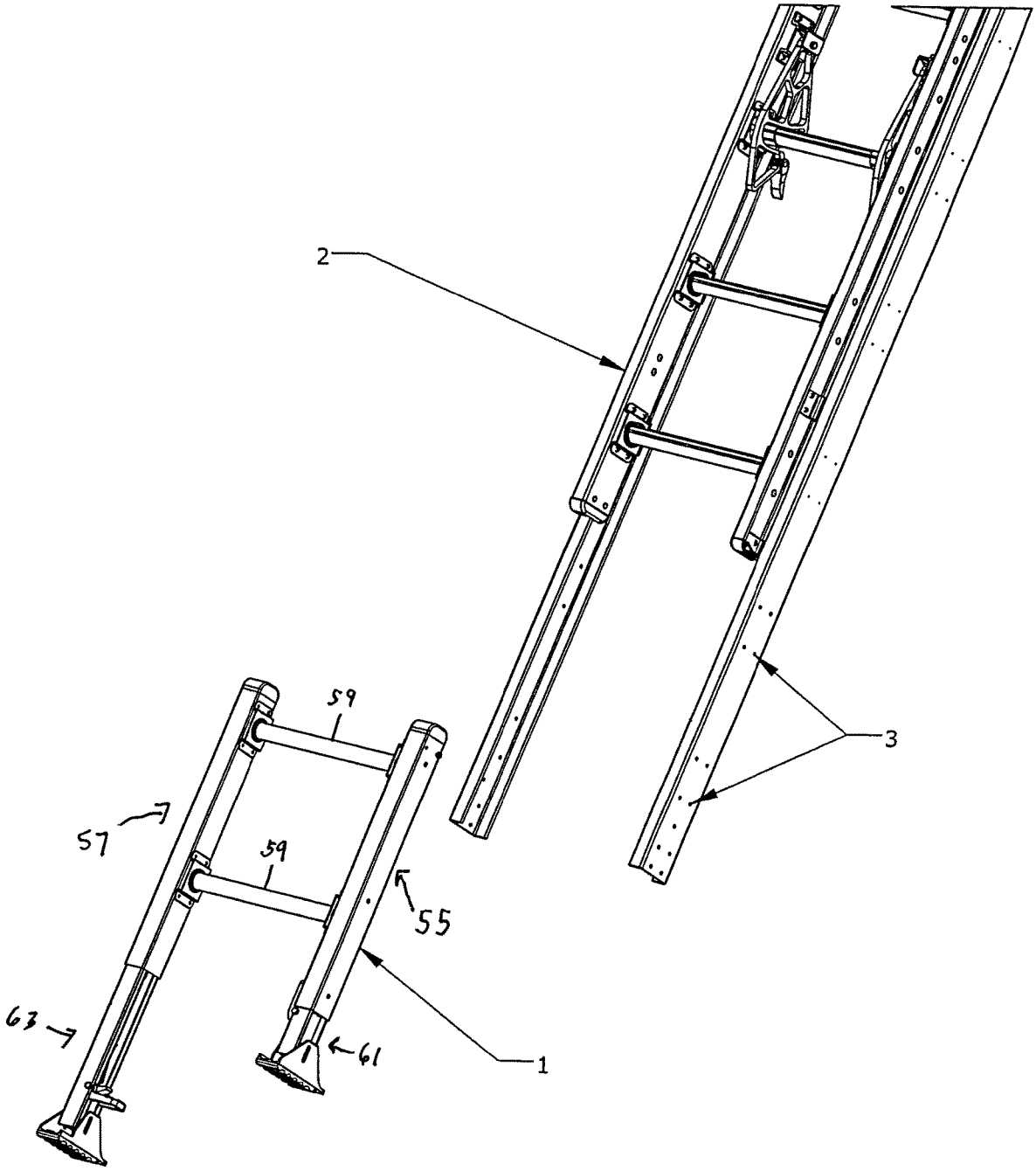
FIG. 2 shows the modular leveler removed from the extension ladder.

In the operation of the invention, as FIGS. 1 & 2 show, the modular leveler 1 is a self-contained ladder leveler designed to be installed in the base section of an extension ladder 2. The modular leveler would be held in place by bolts or rivets through holes 3 in the ladder rails. The modular leveler would be mounted in the space normally occupied by the two lowest rungs of the ladder.

Figure 3:
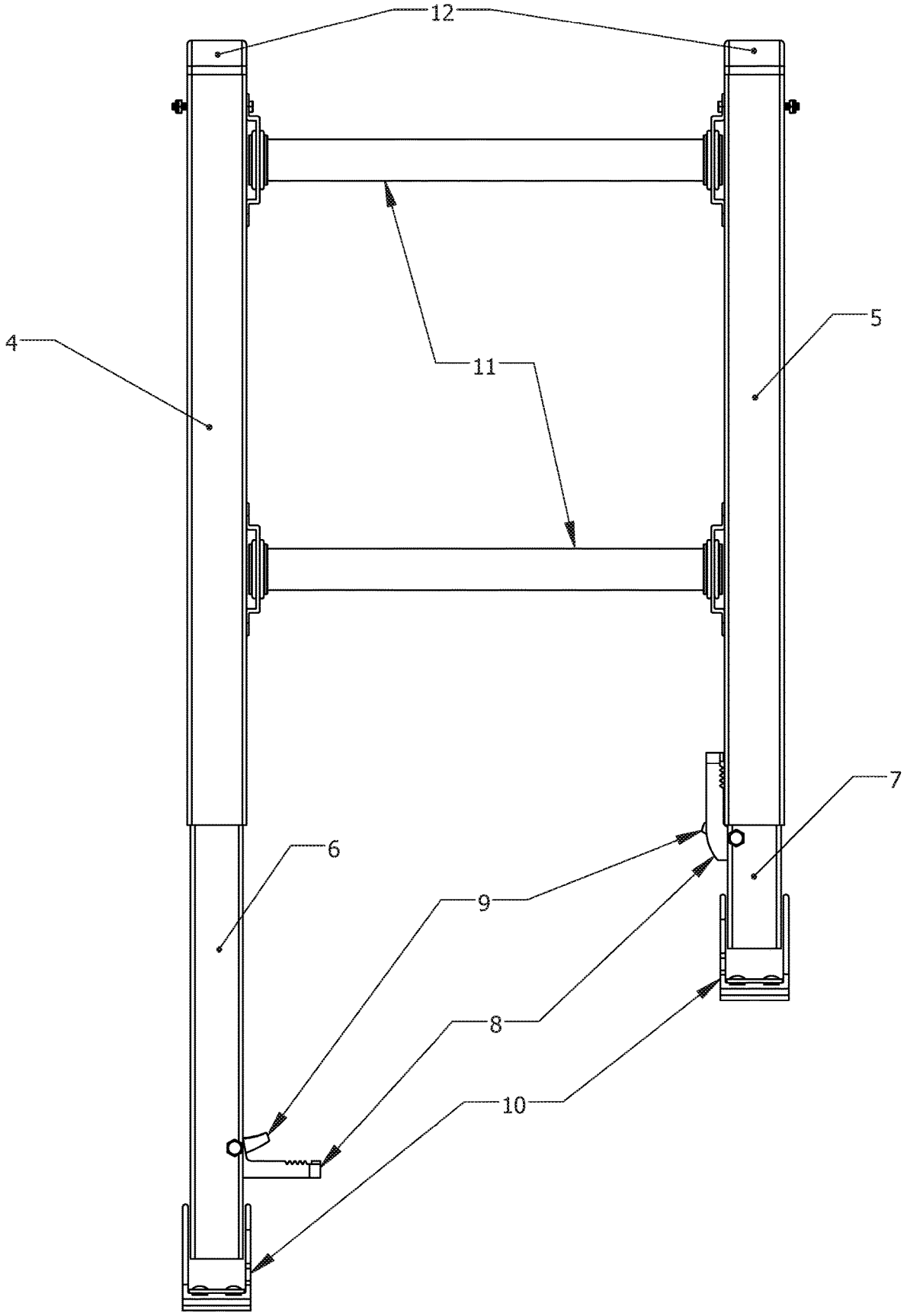
FIG. 3 shows a front view of the modular leveler, left leg extended, right leg retracted.
Figure 4:
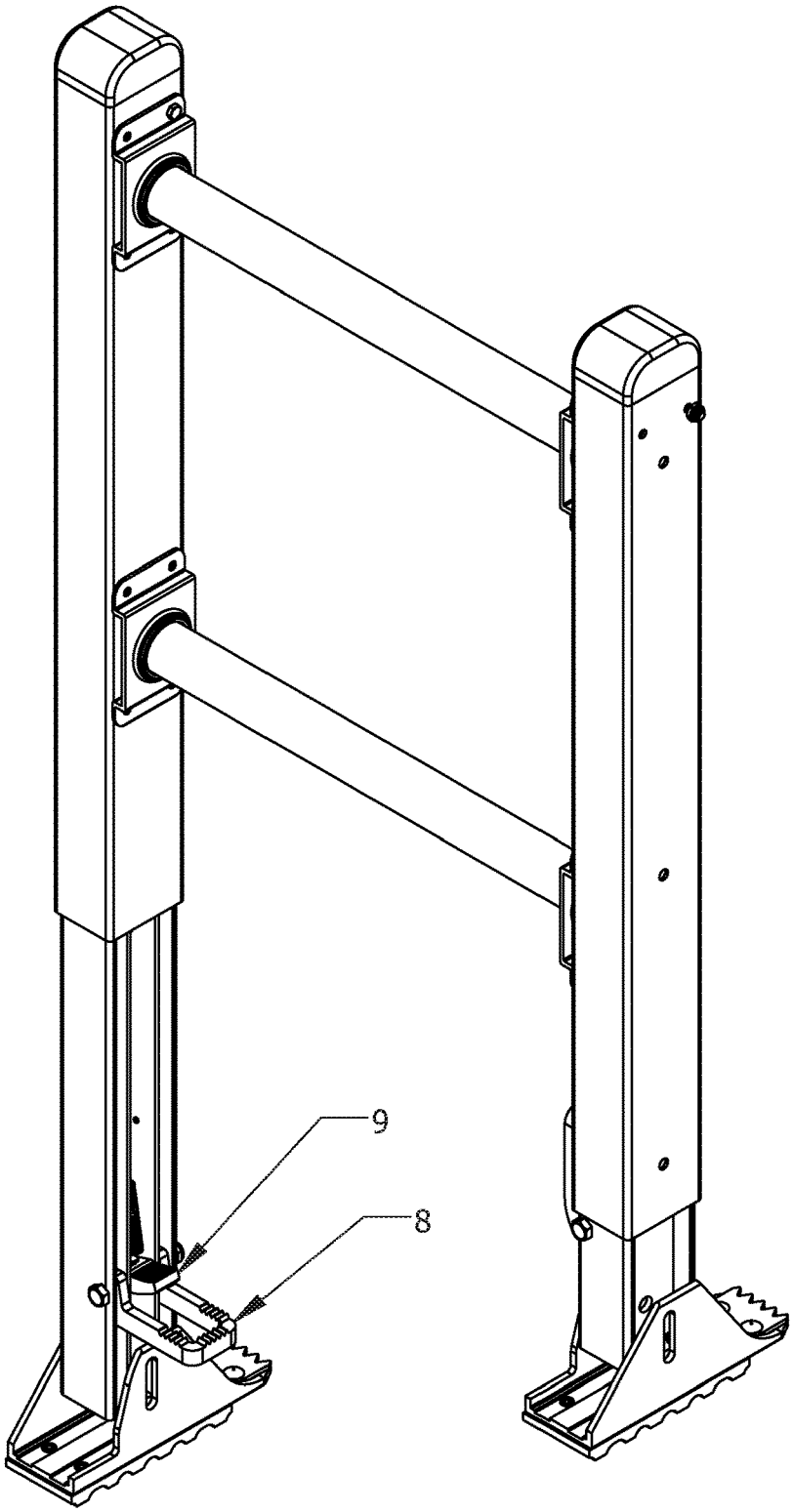
FIG. 4 shows a perspective view of the modular leveler of FIG. 3.

FIGS. 3 and 4 show key components of the modular leveler. Left and right housings 4 and 5 contain left and right leg assemblies 6 and 7. Foldable foot pegs 8 and latches 9 are located on both leg assemblies. Swivel feet 10 are attached to the lower ends of the leg assemblies. Two rung and rung plate assemblies 11 are riveted to the housings and serve to rigidly connect the two housings. End caps 12 close off the upper ends of the housings. It should be noted that these key components together form a single unit or module that is attached to the base section of the extension ladder 2, as described above.

Figure 5:
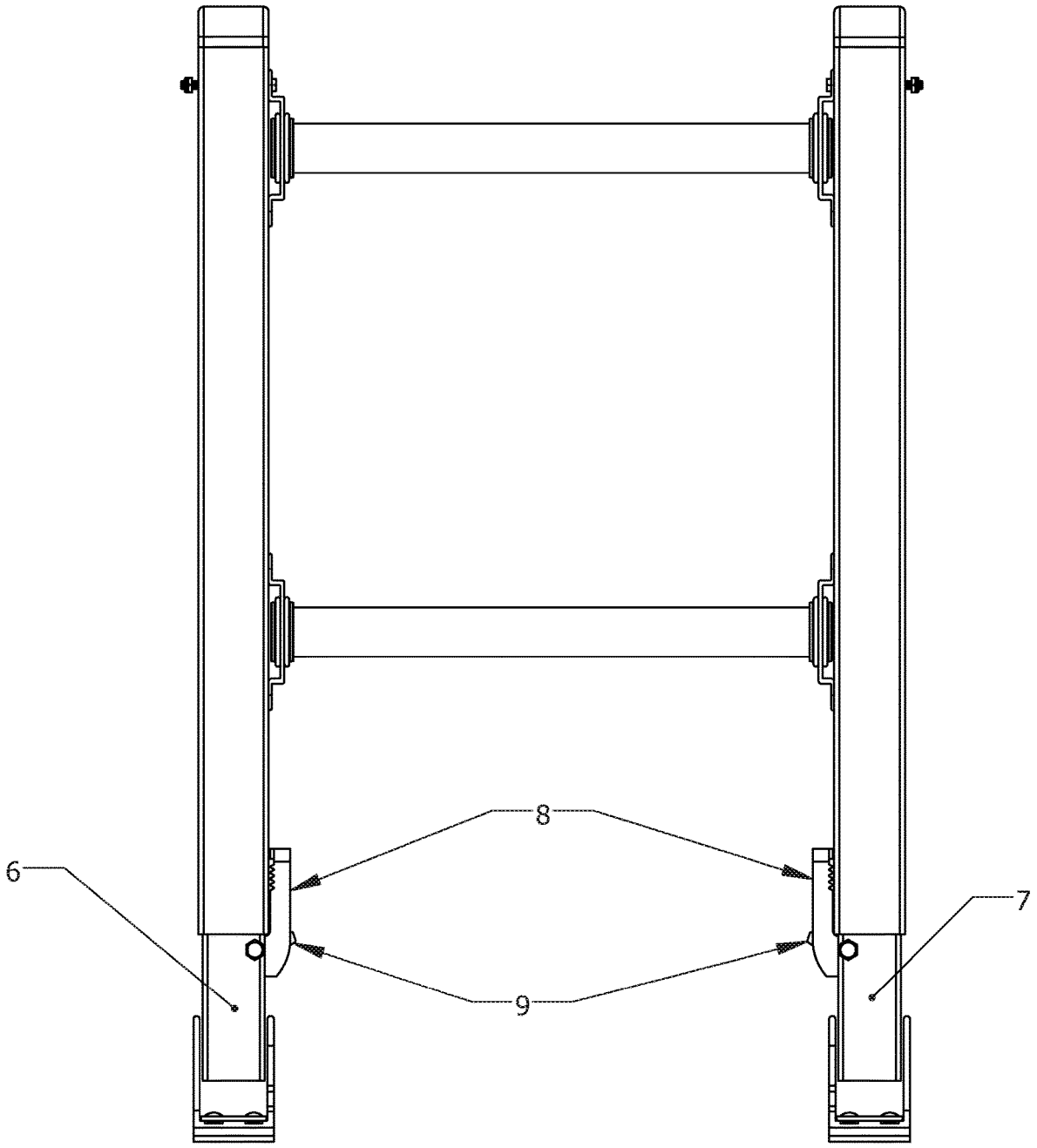
FIG. 5 shows a front view of the modular leveler, both legs retracted.

FIG. 5 shows the modular leveler with both leg assemblies 6 and 7 fully retracted and both foot pegs 8 folded. Notice that when the foot pegs are folded, the latches 9 are protected and inaccessible. This is in contrast to FIG. 3 in which one of the foot pegs is in the down position and the latch is exposed.

Figures 6A, 6B, 6C:
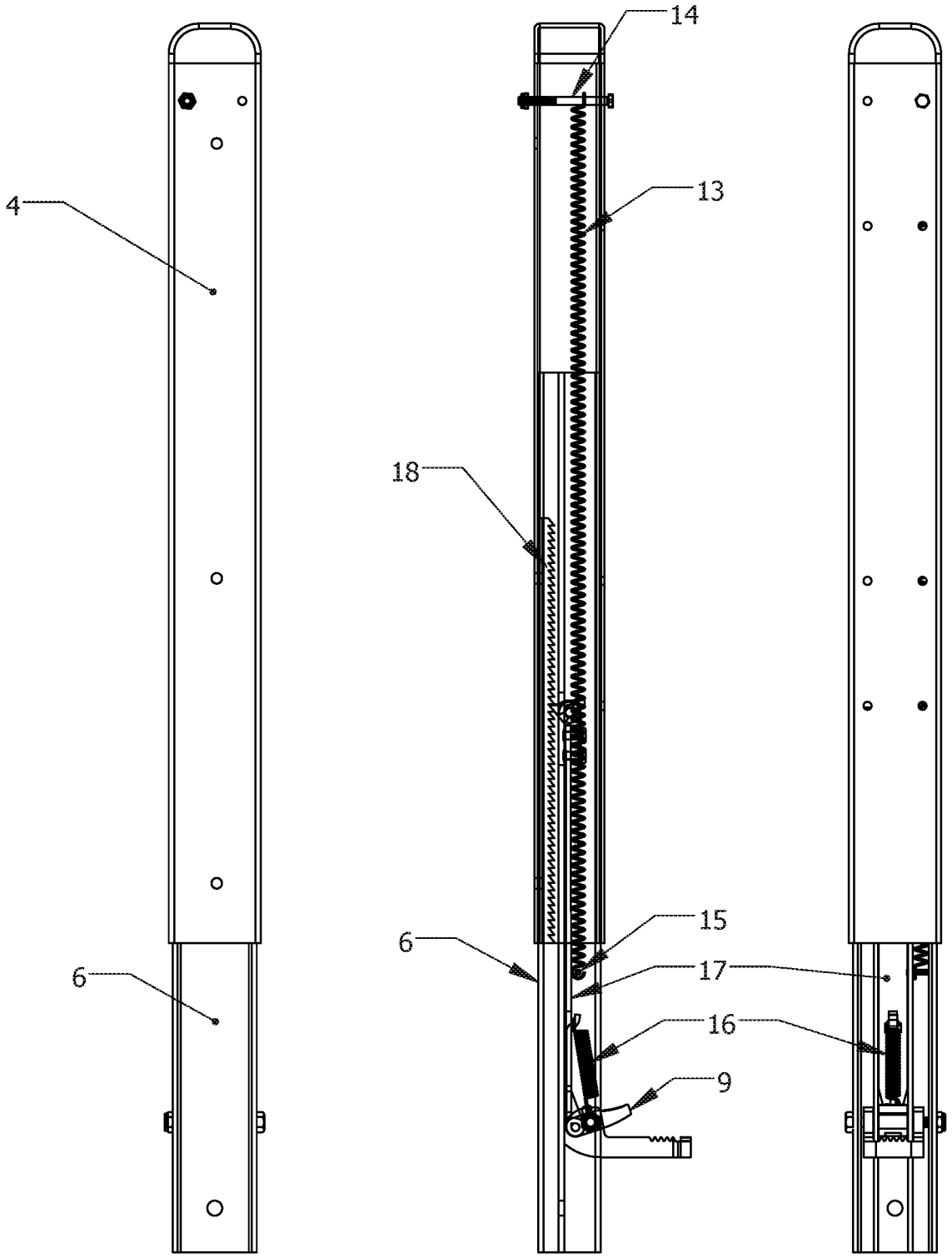
FIGS. 6A, B, and C show, respectively, left side, front side transparent, and right side views of the left leg and housing assembly of the modular leveler.

FIGS. 6 A, B, and C show only the left side housing 4 and leg assembly 6. (Left and right side housings and leg assemblies are symmetric) The swivel foot has been removed. FIG. 6B is a transparent front view showing the key internal components of the leg assembly. The retractor spring 13 is fixed at the upper end to a bolt 14 in the housing 4. The lower end of the retractor spring is hooked over a pin 15 in the leg assembly 6. The retractor spring serves to retract the leg up into the housing when the leg is unlatched and free to move. The latch spring 16 is attached at its upper end to a hook on the pawl assembly 17 and at its lower end to the latch 9. The latch spring biases the latch toward its upper position which in turn biases the pawl assembly into engagement with the rack 18. The rack 18 is mounted rigidly to the inside of the housing.

Figures 7A, 7B, 7C:
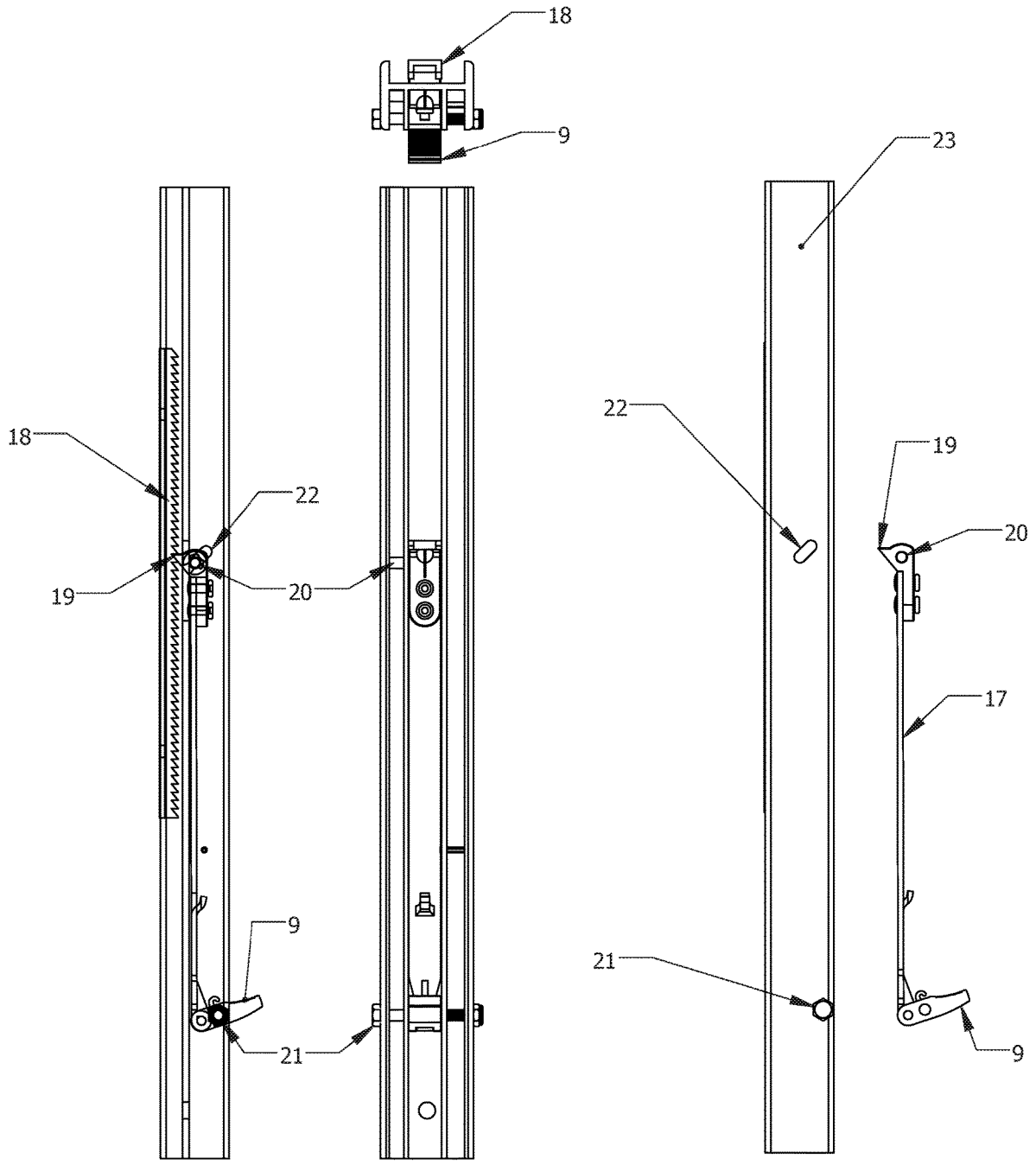
FIGS. 7A, B, and C show, respectively, front side transparent, right side, and front side partially exploded views of the left leg assembly.

FIGS. 7A, B, and C show the leg assembly without the housing, springs, or the foot peg. The rack 18 is still shown though it is not part of the leg assembly.

FIGS. 7A and 7B are front and right side views of the leg assembly. FIG. 7C shows the pawl assembly 17 and latch 9 exploded out from the leg body 23.

The latch 9 pivots on a bolt 21 in the leg body 23. The pawl tip 19 is designed to engage the teeth on the rack 18. A pawl pin 20 is mounted in the upper end of the pawl assembly and is designed to slide in a diagonal slot 22 in the leg body 23 when the pawl assembly is assembled to the leg body.

Figure 8A:
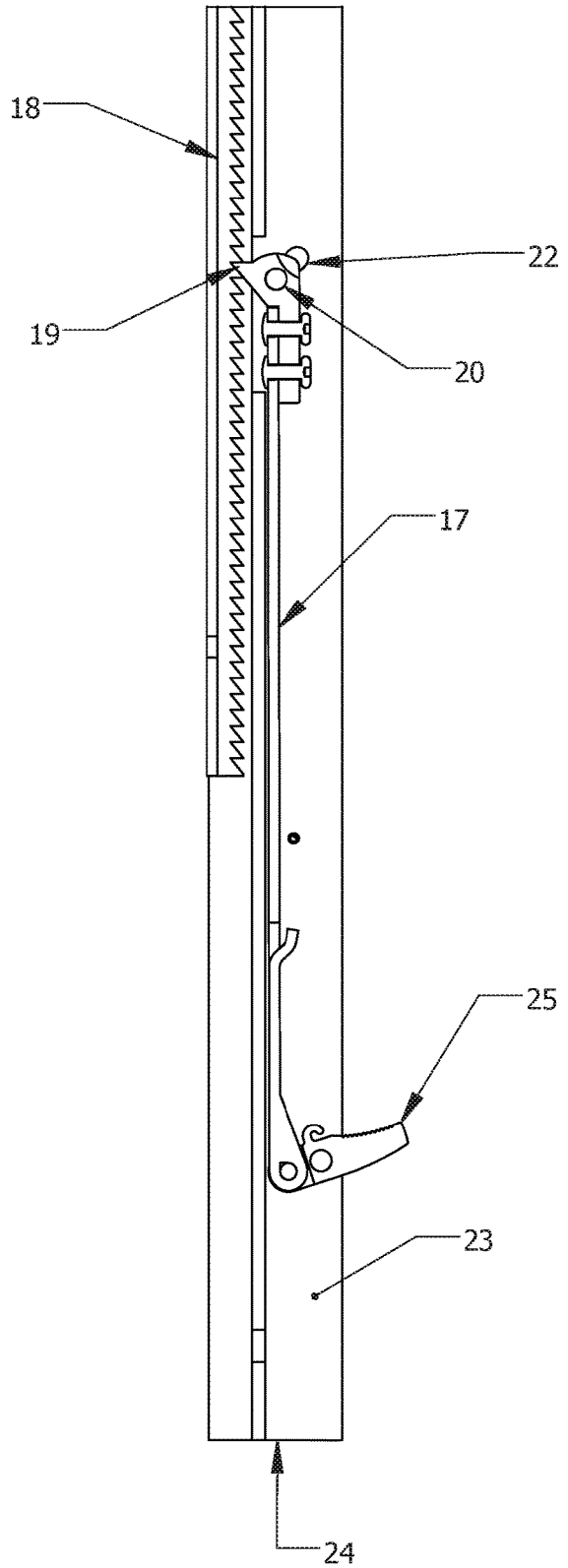
FIGS. 8A and B show cut away front side views of the left leg assembly in the latched and unlatched condition, respectively.

FIGS. 8A and B are cutaway views of the leg assembly showing the operation of the latch, pawl assembly, and rack.

FIG. 8A shows the condition when the leg has been extended the desired amount and the ladder is in use.

It can be seen that a force 24 applied upward on the bottom of the leg body 23 is transmitted from the lower end of the diagonal slot 22 to the pawl pin 20, to the pawl tip 19, and to the rack 18 which ultimately is rigidly attached to the ladder. Because the diagonal slot 22 is sloped at an angle of approx. 45 degrees, the greater the force 24, the greater is the force tending to keep the pawl tip 19 engaged with the rack 18.

Figure 8B:
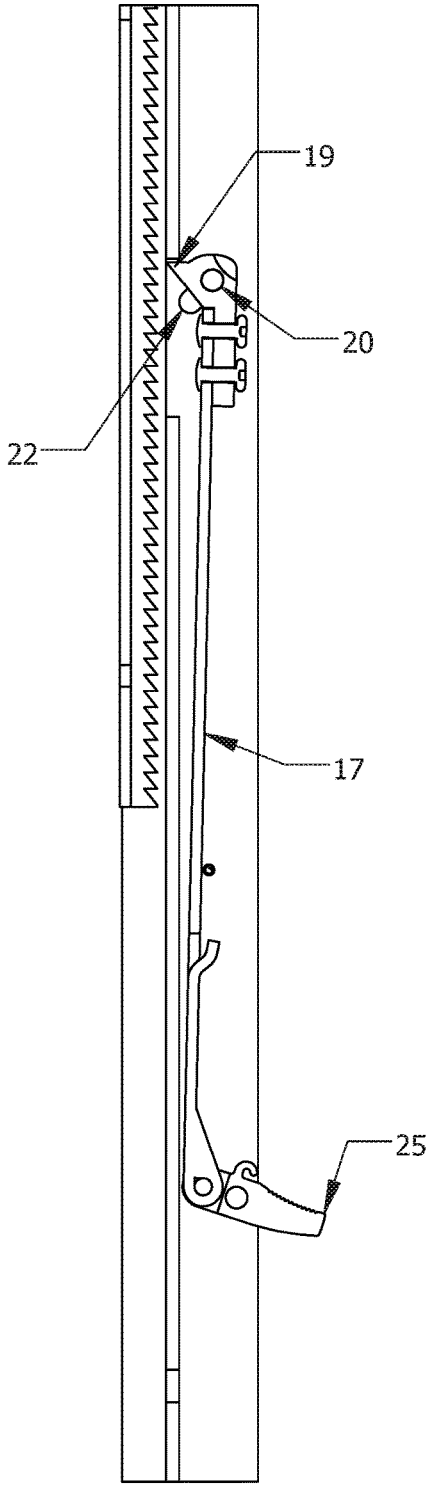

FIG. 8B shows the condition when user desires to retract the leg. The user pushes down on the tip 25 of the latch. This action raises the pawl assembly 17 relative to the leg body 23 which causes the pawl tip 19 to move up and away from engagement with the rack 18 as the pawl pin 20 is guided by the diagonal slot 22. Once the pawl tip is disengaged from the rack, the leg assembly is free to rise relative to the rack (and ladder) under the influence of the retractor spring (13, FIG. 6).

In use, to lower a leg in order to level the ladder, the user would push down on the tip of the foot peg to extend the leg, preferably with the user's foot, but not on the latch so the pawl assembly continues to push against the teeth of the rack. The user would typically not be standing on a rung of the ladder when pushing down on the tip of the foot peg with the user's foot. The pawl assembly will automatically "ratchet" over the teeth of the rack as the pawl assembly moves along the teeth of the rack until the desired extension is achieved. The bias force of the extension spring causes the pin to seat and be held against the associated tooth at the desired extension, since the latch is not pushed down, while the foot peg is pushed down. Putting weight on the ladder will cause the pawl tip to be firmly and immovably engaged with the rack by the increased weight creating increased force against the associated tooth at the desired extension.

To retract a leg, the user would first take the weight off the leg to be retracted. Then the user pushes down on the foot peg and latch together. This action disengages the pawl tip from the rack and allows the leg to rise under the control of the user's foot which is resting on the foot peg.

The fact that the weight must first be taken off the leg to be retracted is a safety feature which positively prevents inadvertent leg retraction. This feature is achieved using a diagonal slot 22.

Figure 9:
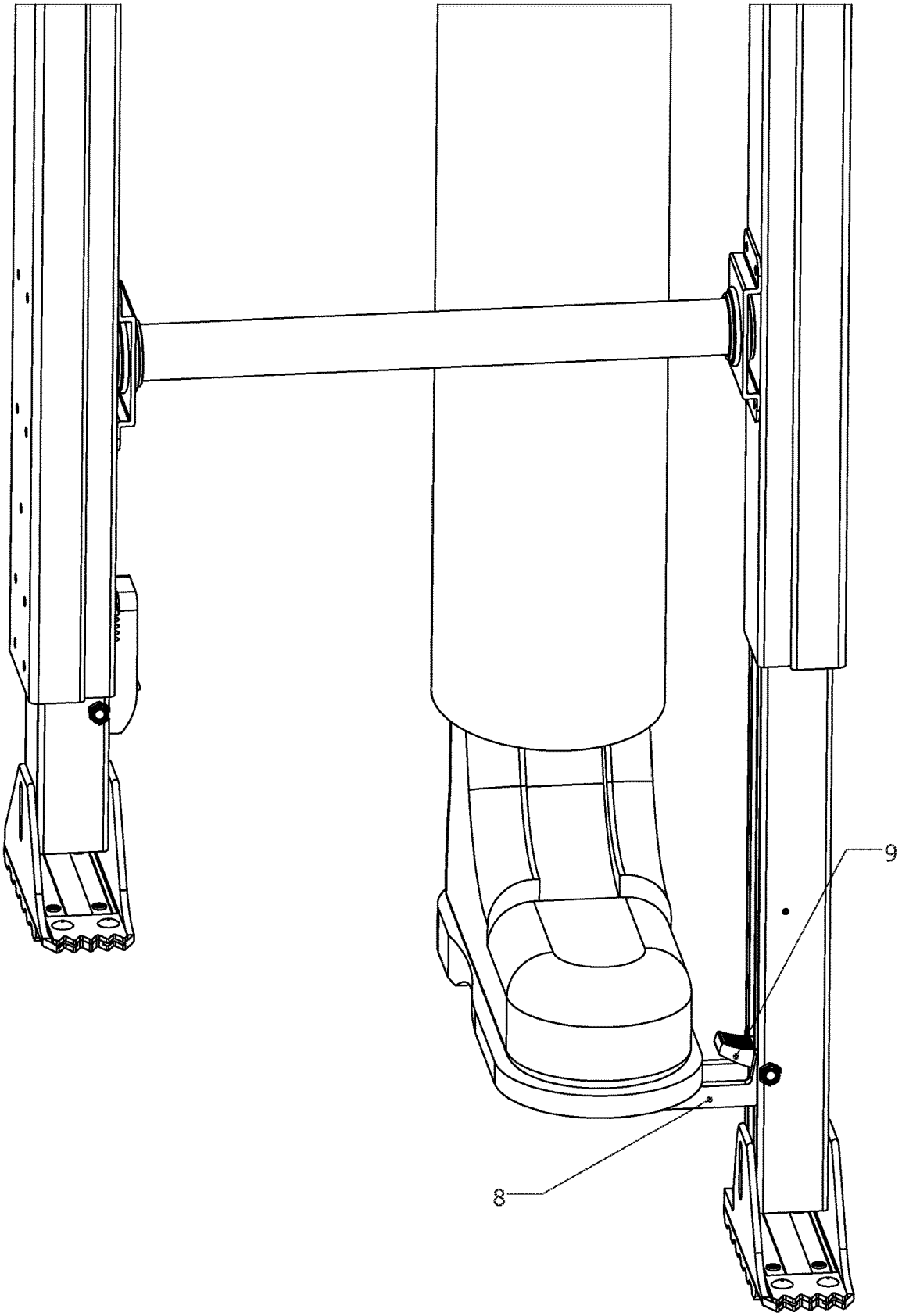
FIG. 9 shows a user's foot on the foot peg but not the latch of the leveler.
Figure 10:
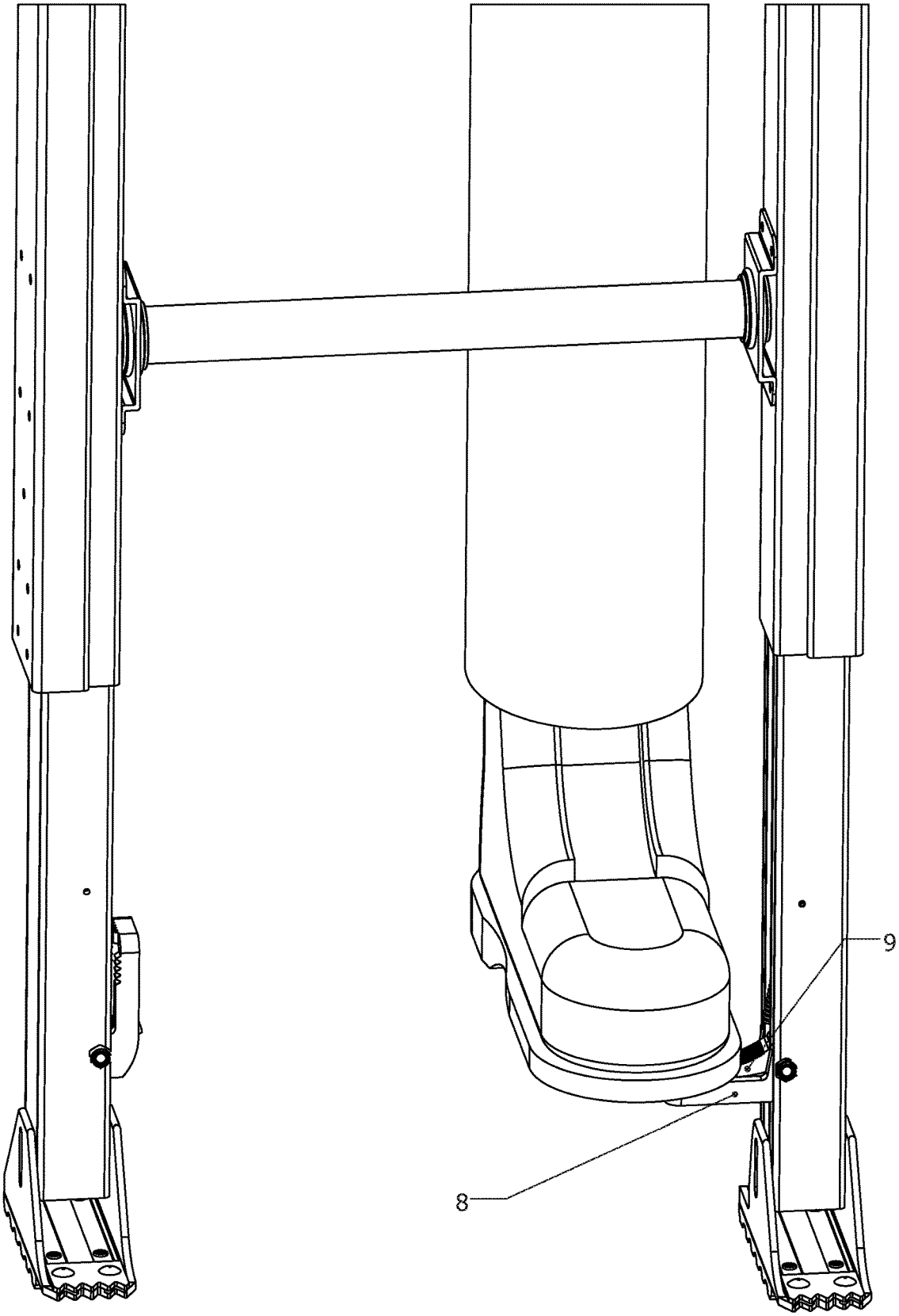
FIG. 10 shows a user's foot on the foot peg and the latch of the leveler.

FIG. 9 shows the user extending a leg by pushing down only on the foot peg 8. FIG. 10 shows the user retracting a leg by depressing the latch 9 while applying pressure on the foot peg 8. With the latch depressed, the user can allow the leg to rise under his control.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A ladder upon which a user climbs comprising:

a first rail;

a second rail;

rungs attached to the first and second rails upon which the user steps;

a first leveler attached to the first rail, the first leveler having a foot peg and a latch, when the user presses on the foot peg and the latch with the user's foot when the leveler is in an extended state, the first leveler moves into a retracted state, the first leveler having a right housing which contains a right leg assembly, the foot peg and the latch are foldably attached to the right leg assembly, the latch is encased by the foot peg when the latch and foot peg are folded so the latch is protected by the foot peg and inaccessible;

a retractor spring fixed in proximity to an upper end of the retractor spring to a bolt in the right housing and hooked in proximity to a lower end of the retractor spring to a pin in the right leg assembly, the retractor spring retracts the right leg assembly into the right housing when the latch is unlatched and the right leg assembly is free to move into the retracted state, the latch is unlatched when the user presses on the foot peg and the latch;

a latch spring and a pawl assembly and a rack with teeth mounted rigidly to an inside of the right housing, the latch spring attached in proximity to an upper end of the latch spring to the pawl assembly and in proximity to a lower end of the latch spring to the latch, the latch spring biases the latch toward an upper position which in turn biases the pawl assembly into engagement with the rack; and a second leveler attached to the second rail.

2. The ladder of claim 1 wherein the latch pivots on a bolt in the right leg assembly, and the pawl assembly has a pawl tip which engages with the teeth on the rack.

3. The ladder of claim 2 including a pawl pin mounted in proximity to an upper end of the pawl assembly which slides in a diagonal slot in the right leg assembly, when the pawl assembly is assembled to the right leg assembly, a force applied upward on a bottom of the right leg assembly is transmitted from a lower end of the diagonal slot to the pawl pin, to the pawl tip and to the rack, because the diagonal slot is sloped at an angle, the greater the force, the greater is the force keeping the pawl tip engaged with the rack.

4. The ladder of claim 3 wherein when a user desires to retract the right leg assembly, the user pushes down on a tip of the latch which raises the pawl assembly relative to the right leg assembly which causes the pawl tip to move up and away from engagement with the rack as the pawl pin is guided by the diagonal slot, once the pawl tip is disengaged from the rack, the leg assembly is free to rise relative the rack under the influence of the retractor spring.

5. The ladder of claim 4 wherein to lower the right leg assembly to level the ladder, the user pushes down on the tip of the foot peg to extend the leg, but not on the latch so the pawl assembly continues to push against the teeth of the rack, the pawl assembly automatically ratchets over the teeth of the rack as the pawl assembly moves along the teeth of the rack until the desired extension is achieved, the bias force of the retractor spring causes the pawl tip to seat and be held against a tooth of the teeth at a desired extension, since the latch is not pushed down while the foot peg is pushed down, putting weight on the ladder causes the pawl tip to be firmly and immovably engaged with the rack by the increased weight creating increased force against the tooth at the desired extension.

6. The ladder of claim 5 wherein the first and second levelers form a modular leveler with rungs attached to and between them, the modular leveler attached by bolts or rivets to the first and second rails.

* * * * *